US006680674B1

(12) United States Patent
Park

(10) Patent No.: US 6,680,674 B1
(45) Date of Patent: Jan. 20, 2004

(54) ADAPTIVE GEOGRAPHIC MAPPING IN VEHICLE INFORMATION SYSTEMS

(75) Inventor: Michael C. Park, Portland, OR (US)

(73) Assignee: Seiko Instruments Inc., Chiba (JP)

( * ) Notice: Subject to any disclaimer, the term of this patent is extended or adjusted under 35 U.S.C. 154(b) by 1,791 days.

(21) Appl. No.: 08/227,609

(22) Filed: Apr. 13, 1994

(51) Int. Cl.[7] ..... G08G 1/09

(52) U.S. Cl. ..... 340/905; 340/910; 340/907; 340/934; 340/989; 340/990; 340/993; 340/995.1; 340/995.12; 340/995.13

(58) Field of Search ..... 340/934, 910, 340/907, 993, 989, 990, 995

(56) References Cited

U.S. PATENT DOCUMENTS 5,164,904 A * 11/1992 Sumner ..... 340/905
5,317,311 A * 5/1994 Martell et al. ..... 340/905

* cited by examiner

*Primary Examiner*—Daryl Pope
(74) *Attorney, Agent, or Firm*—Marger Johnson & McCollom

(57) ABSTRACT

A travel information system broadcasts a stream of traffic event information relative to a given road network and a information collecting devices carried in vehicles travelling within the road network each filter among the stream of traffic event information to display only those traffic events relative to a selected travel route of the host vehicle. Each stored travel route is defined by placing the information device in a learn mode to collect a sequence of current vehicle position values during travel along the route. The information device need not include a costly and difficult to maintain large scale database representing the road network. The device thereby constructs and maintains a collection of frequent travel routes specific to the vehicle carrying the device and need not be updated to reflect changes in the road network, but rather allows the user to simply redefine the stored travel routes in light of current road usage and route selection.

13 Claims, 5 Drawing Sheets

ADAPTIVE GEOGRAPHIC MAPPING IN VEHICLE INFORMATION SYSTEMS

BACKGROUND OF THE INVENTION

The present invention relates generally to vehicle information systems, and particularly to vehicle information systems providing event information to vehicles traveling a given route.

A variety of traffic related information is now available for use in aiding vehicle operation; especially in urban road networks with potential for congestion and significant traffic jams affecting travel time. For example, some cities now have traffic speed sensing devices collecting traffic flow rates along given sections of roadways traveled heavily by commuter traffic. Such information can be collected and voice broadcast by AM and FM conventional radio stations in the form of verbal traffic reports, e.g., the morning traffic report, to inform commuters of potential slowdowns, and thereby provide commuter opportunity to select an alternate travel route. Other examples of traffic event information are traffic jams, vehicle wrecks affecting traffic flow, closure of particular routes, and construction activity affecting traffic flow. Any such information of interest to drivers shall be referred to herein as "traffic events" and may be considered generally anything of interest to the traveler along a given route.

An information device likely to be soon commonly incorporated into vehicles is a position detecting system, e.g., the well known global positioning system (GPS) provided by satellite broadcast to determine location of a GPS device within a given number of meters. Vehicles with GPS capability will have the very useful feature of tracking position along a given route as represented by a digital map database and displaying traffic events along the current vehicle route. The general assumption has been that each vehicle will carry a massive database of road networks, i.e., digital maps, as a reference mechanism in presenting traffic event information to the vehicle driver. For example, the digital map shows graphically collected traffic event information as a display for the vehicle driver.

Reference to a digital map also supports filtering of most traffic event information, i.e., excluding from display traffic event information not relevant to the current travel route, current position, or intended route.

Massive digital map databases are, however, inherently expensive and difficult to include in mass produced products such as would be appropriate in a GPS-capable car radio consumer product. Digital map databases require license fees, large amounts of memory, frequent and expensive revision, and generally cannot be comprehensive enough to allow use throughout the entire world. It is not economically feasible to provide in an inexpensive consumer product a digital map database covering the entire world, or at least a significant geographic region. If the device is prepared for use throughout the world, an incredibly massive digital map is required with significant cost and maintenance requirements. If only selected geographic regions are incorporated into the digital map, the device cannot be used outside such geographic regions without post-manufacture modification or manipulation of numerous storage devices, e.g., a library of CD-ROM discs.

Vehicle information devices desirably include a digital map for filtering the massive volume of traffic event information. The larger and more comprehensive the map, the better suited the device is for use in any given area. A practical constraint exists, however, for consumer products in a price range suitable for common use in vehicles, i.e., a vehicle GPS-radio.

It would be desirable, therefore, for a vehicle information device to be usable in any geographic area as manufactured yet still maintain an ability to filter, i.e., exclude from display, irrelevant traffic event information relative to a current travel route. In particular, it would be desirable to avoid a requirement of procuring and maintaining a massive digital database in the traffic information device, yet maintain an ability to reference a selected travel route and thereby filter irrelevant traffic event information. The subject matter of the present invention provides such a vehicle travel information device.

SUMMARY OF THE INVENTION

In accordance with the present invention, a traffic information device in a vehicle includes a vehicle position detecting device and collects vehicle position information while travelling along a given travel route. The device thereby learns travel routes and stores a collection frequently travelled routes. After a given travel route is so defined and stored, the device references the stored travel route to filter the massive volume of traffic event information available and thereby display only those traffic event items relevant to the selected travel route.

The subject matter of the present invention is particularly pointed out and distinctly claimed in the concluding portion of this specification. However, both the organization and method of operation of the invention, together with further advantages and objects thereof, may be best understood by reference to the following description taken with the accompanying drawings wherein like reference characters refer to like elements.

BRIEF DESCRIPTION OF THE DRAWINGS

For a better understanding of the invention, and to show how the same may be carried into effect, reference will now be made, by way of example, to the accompanying drawings in which.

DETAILED DESCRIPTION OF A PREFERRED EMBODIMENT

Figure 1:
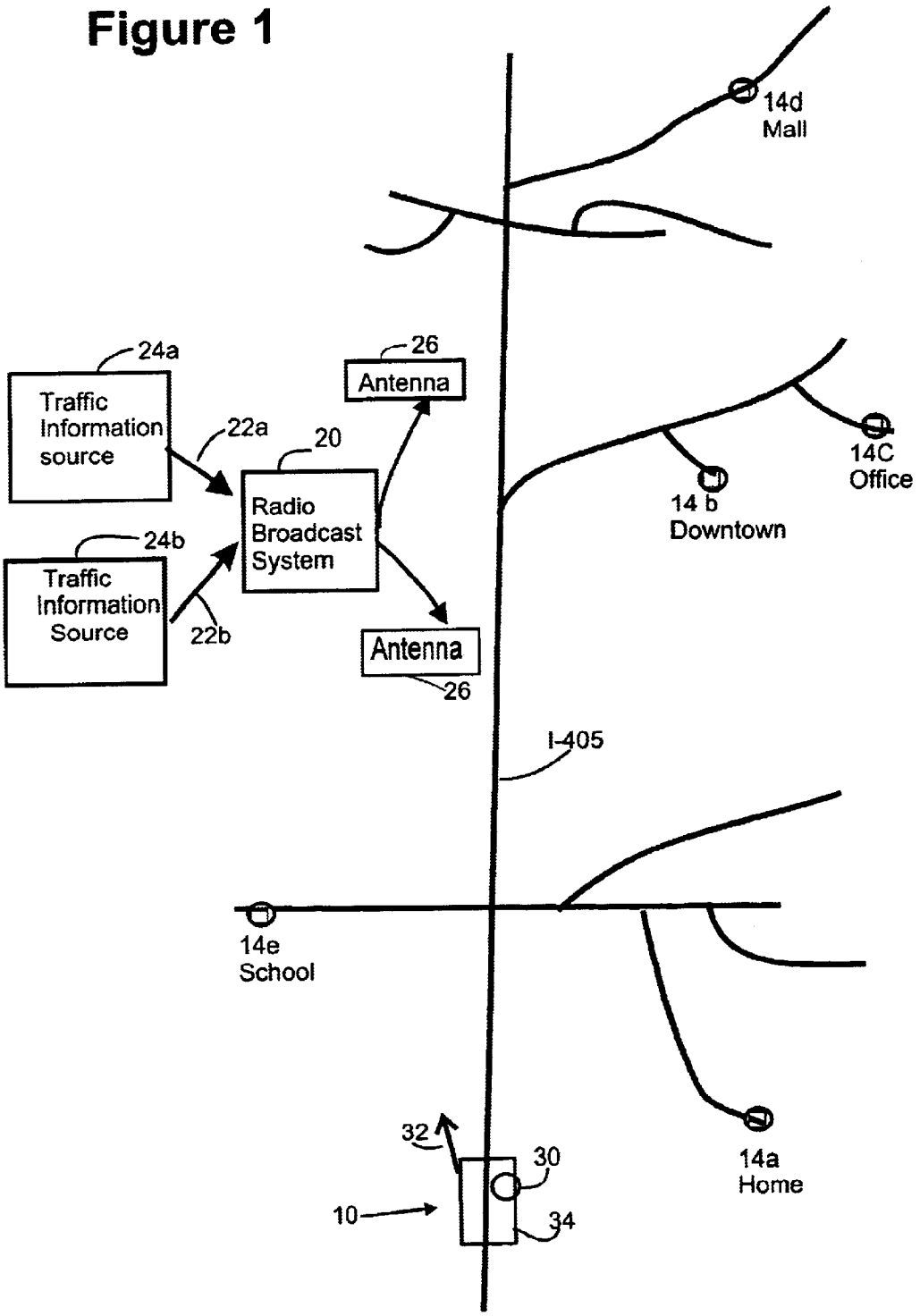
FIG. 1 illustrates a traffic event broadcasting system, a given road network and a vehicle travelling in the road network with a travel information device in accordance with the present invention.

In FIG. 1, a vehicle 10 travels within a road network 12. Network 12 includes main arterial roadways as illustrated, but as may be appreciated would be significantly more complex. For the present illustration, it will be understood that vehicle 10 travels throughout road network 12 along any selected travel route. Locations 14, individually locations 14*a*–14*e*, illustrate frequent travel routes within network 12. Thus, vehicle 10 typically travels from a home location 14*a* to each of a downtown location 14*b*, office location 14*c*, mall location 14*d*, and school location 14*e*. Vehicle 10 would typically then return from one of locations 14*b*–14*e* to home location 14*a*. While not restricted to such specific travel routes, it will be understood that use of vehicle 10 is predominated by travel to and from the illustrated locations 14.

Also illustrated in FIG. 1, a radio broadcast system 20 receives traffic event information 22 from traffic information sources 24 and broadcasts traffic event data, i.e., structured information not voice broadcast, relative to road network 12 in a radio data transmission 26. Thus, each traffic information source 24 provides a particular category of traffic event information 22. Traffic information source 24*a*, for example, provides speed of travel along particular sections of the road network 12, such information being useful to commuters wishing to avoid congestion during peak traffic hours. Traffic information source 24*b* provides information regarding route closures within the network 12. As may be appreciated, a variety of traffic information sources 24 make available a corresponding variety of traffic event information 22 to radio broadcast system 20.

Each item of traffic event information 22 indicates of the nature of the traffic event, e.g., a textual description of the event, and a location within network 12. The location information may be expressed directly as latitude and longitude coordinates, or a range of such coordinates, or by reference to specific roads within network 12. It will be understood, however, that the location portion could ultimately be expressed as latitude and longitude information, e.g., converted if necessary by the radio broadcast system 20. Radio transmission 26 thereby provides traffic event information including a descriptive portion, e.g., a textual description, and a position portion, e.g., a latitude and longitude datum pair or range of latitude and longitude values.

Vehicle 10 includes a traffic information device 30 receiving by way of its antenna 32 the radio transmission 26 for collection of traffic event information provided by radio broadcast system 20. Device 30 further includes a display 34 presenting to the driver of vehicle 10 traffic event information relative to the road network 12. In accordance with the present invention, traffic events presented on display 34 are relevant to a selected travel route of vehicle 10, i.e., device 30 filters from all the traffic events available in radio data transmission 26 only those relevant to the current travel route for vehicle 10. Such capability is provided, however, without requiring device 30 to include a massive digital map of the road network 12.

Figure 2:
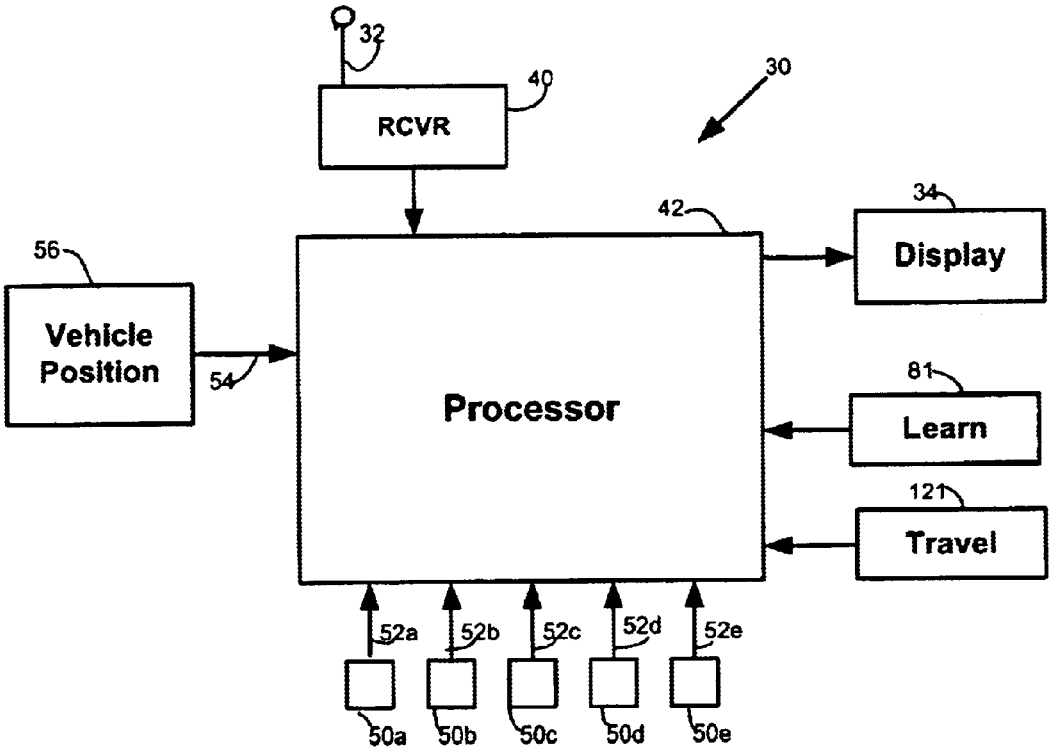
FIG. 2 is a block diagram of the travel information device of the vehicle of FIG. 1.

FIG. 2 illustrates in block diagram the travel information device 30 of FIG. 1. A radio receiver 40 couples antenna 32 to a processor 42. Processor 42 thereby monitors the stream of traffic event information provided in radio transmission 26. A set of preset buttons 50, operable by the driver of vehicle 10, apply corresponding inputs 52 to processor 42. As will be described more fully hereafter, each of the preset buttons 50, individually 50*a*–50*e*, may be associated with one of the locations 14 within road network 12. Processor 42 maintains such association and reacts to each of the corresponding inputs 52*a*–52*e* in implementation of the present invention. Displaying in some fashion a mnemonic or literal indicator of the association between each of preset buttons 50 and a location 14, e.g., name or label the button 50*a* "HOME", allows the driver of vehicle 10 to view the association between a preset button 50 and one of the locations 14 in road network 12.

Processor 42 receives vehicle location data 54 from a vehicle position block 56. As may be appreciated, vehicle position block 56 may be implemented according to a variety of mechanisms, but as contemplated under the preferred embodiment of the present invention the vehicle position block 56 includes a global position system (GPS) receiver providing latitude and longitude values as the vehicle position data 54 to processor 42. Thus, processor 42 can at any given time collect the current vehicle position from the vehicle position block 56.

Processor 42 operates generally to collect traffic event information by way of radio receiver 40 and to present only relevant traffic event information on the display 34. A preliminary learn mode invoked by operation of learn button 81 causes device 30 to collect vehicle position information and thereby construct a representation of a travel route as a sequence of latitude and longitude values. A travel route mode invoked by operation of button 121 allows device 30 to reference one of a collection of stored travel routes as a basis for filtering among the traffic event items collected by way of radio receiver 40.

Figure 3:
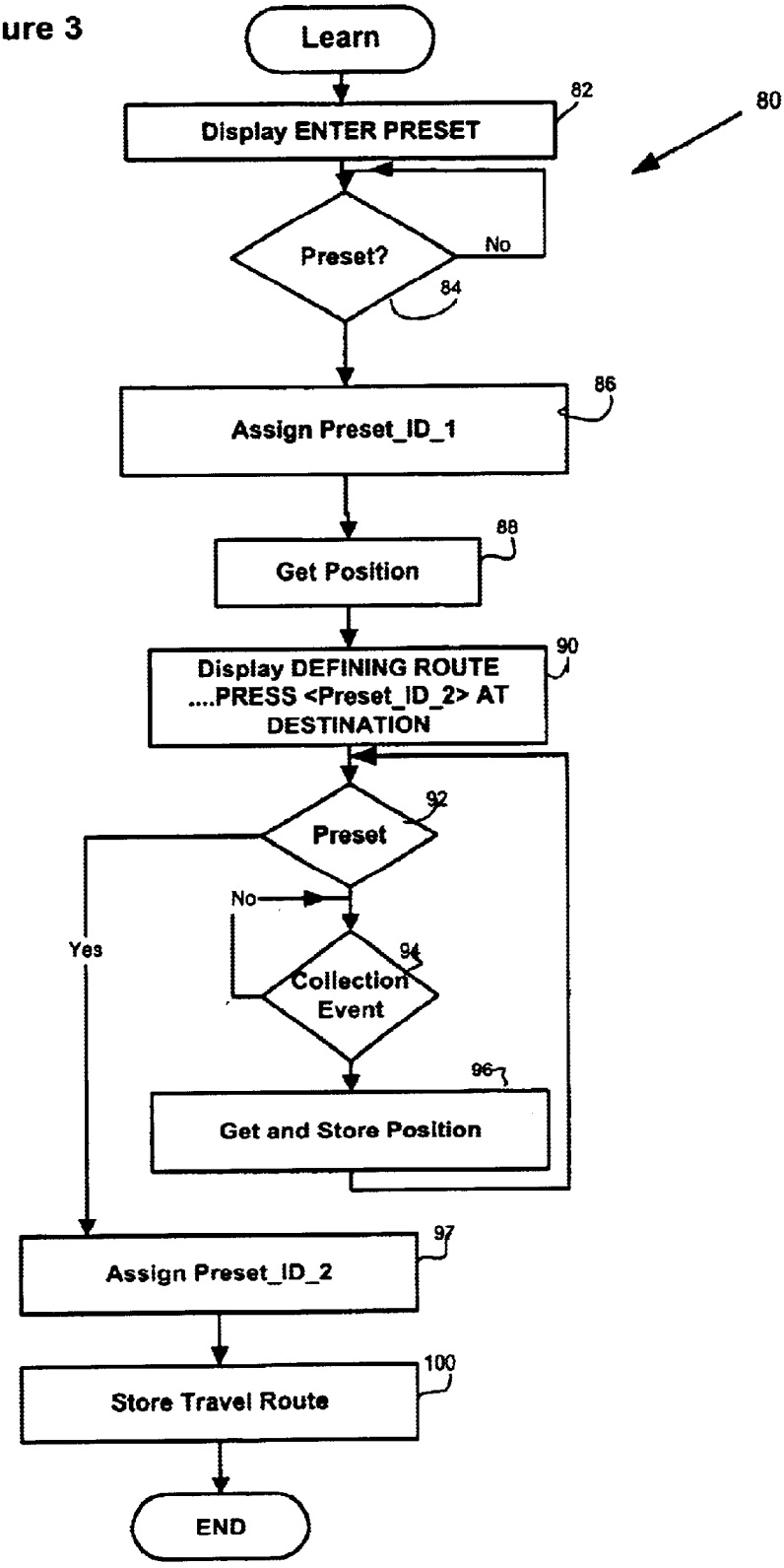
FIG. 3 is a flow chart illustrating operation of the travel information device of FIG. 2 in a learn mode collecting and storing travel route information.

FIG. 3 illustrates a learn mode 80 invoked by the operator of vehicle 10 by operation of learn button 81. In FIG. 3, learn mode 80 begins in block 82 where device 30 displays the message ENTER PRESET and proceeds to decision block 84 where device 30 loops until the user presses one of preset buttons 50. When the user presses one of preset buttons 50, device 30 advances to block 86 and associates the variable Preset_ID_1 with the activated preset button 50. Continuing to block 88, device 30 collects the current vehicle position and stores such position in a travel route data structure described more fully hereafter. In block 90, device 30 displays the message DEFINING TRAVEL ROUTE FOR <Preset_ID_1> PLEASE ENTER PRESET BUTTON AT DESTINATION. At this point, device 30 is prepared to collect vehicle position information during travel until the operator selects another one of the preset buttons 50 indicating arrival at the destination of the travel route under definition.

Processing then advances to decision block 92 to determine if another one of preset buttons 50 has been depressed. If no button 50 has yet been depressed, processing advances to decision block 94 where device 30 loops until a position collection event occurs. As may be appreciated, device 30 determines in some fashion when current vehicle position should be collected in building a travel route model. Uniform spacial resolution of the travel route definition is achieved by, for example, monitoring vehicle position and declaring a collection event at fixed increments, e.g. one tenth mile, of travel.

Eventually, a collection event occurs and processing advances from decision block 94 to block 96 where device 30 collects current vehicle position and stores the vehicle position in the travel route data structure. Processing then returns to decision block 92 where device 30 determines whether one of preset buttons 50 has been depressed and the travel route definition thereby terminated. Thus, processing loops among the blocks 92, 94, and 96 collecting intermittently current vehicle position and building a travel route data structure representing movement of the vehicle within the road network 12. Eventually, the user depresses one of preset buttons 50 and processing advances to block 97 where device 30 assigns the current vehicle position to the variable Preset_ID_2 as representation of the end point of the defined travel route.

At this point, device 30 has variables Preset_ID_1 and Preset_ID_2 corresponding to the origin and destination locations 14 and also each associated with given latitude and longitude positional information. Furthermore, device 30 has a sequence of latitude and longitude datum pairs indicating a travel route coupling a point of origin and point of destination associated with two of the preset buttons 50. In block 100, device 30 stores the collected travel route in association with the relevant preset buttons 50. As may be appreciated, device 30 can maintain a collection of such travel routes for storage and later reference.

Figure 4:
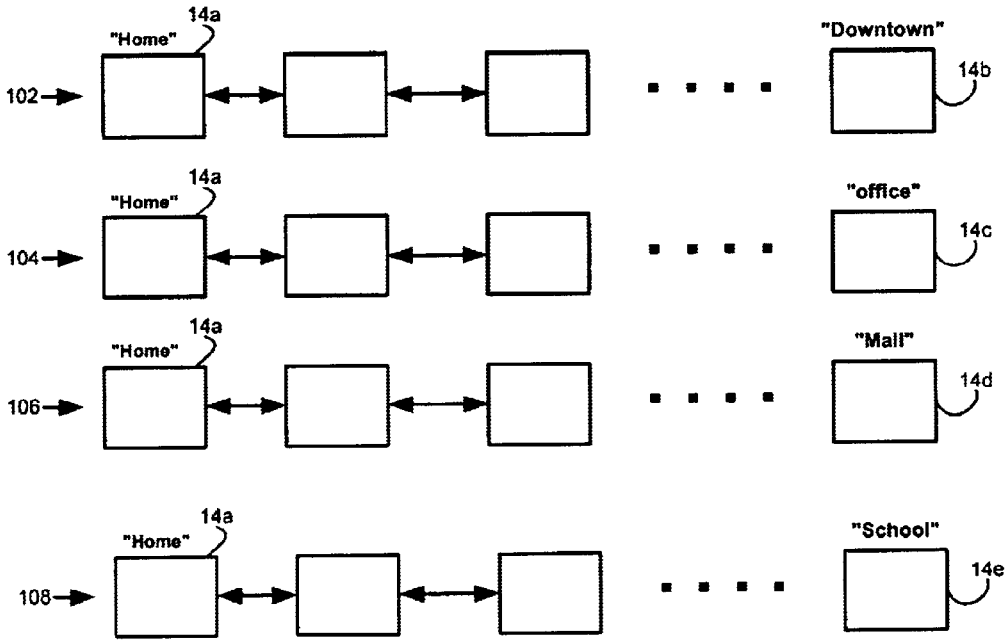
FIG. 4 illustrates a collection of travel route data structures created and used by the device of FIG. 2 relative to the road network of FIG. 1.

FIG. 4 illustrates several travel routes stored within the device 30 and representing travel among the locations 14. In FIG. 4, a first travel route 102 indicates an origin at location 14*a* and a destination at downtown location 14*b* defined by the driver of vehicle 10 in traversing road network 12 from home location 14*a* to downtown location 14*b*. Similarly, travel routes 104, 106, and 108 represent travel within road network 12 from home location 14*a* to each of office location 14*c*, mall location 14*d*, and school location 14*e*, respectively. While the data structures illustrated in FIG. 4 each represent travel among the illustrated locations 14, travel routes among any selected points within road network 12 may be defined by the operator of vehicle 10.

Furthermore, while the data structures in FIG. 4 may be originally defined with an origin at a given location 14 and a destination at a second location 14, the same travel route data structures may be referenced in the reverse direction, e.g., travel route 102 also represents travel from the office location 14*b* to the home location 14*a*. Accordingly, data structures employed in the representation of travel routes 102–106 should be capable of traversal in either direction. For example, a double linked list or consecutive memory locations could be used to store the sequence of latitude and longitude information representing each travel route. Similarly, a single linked list could be converted when necessary to represent a reverse order of the items stored therein.

As may be appreciated, the data structures may be post-processed to conserve memory usage. For example, a long sequence of latitude and longitude datum pairs may be condensed by identifying straight line portions of the route and storing the endpoints of each straight, or significantly straight, segment of the route. In referencing the geographic proximity of traffic events, therefore, the comparison step should account for locations expressly found in the selected travel route data structure, locations along segments of the route, and locations near, i.e., with a given range of proximity, the selected travel route. Generally, each travel route data structure should provide a geographic mapping of the associated travel route, but not necessarily expressly store each and every point therealong so long as the route is sufficiently represented for the purpose of determining geographic relevance of a given traffic event location.

An additional enhancement to the travel route data structure maintains a "path width" value for each stored route where the path width value specifies a distance from the route within which traffic events are to be taken as being relevant thereto. Under such enhancement, device 30 would include additional programming to collect a "path width" value in conjunction with programming of FIG. 3 and appropriate storage in conjunction with the data structures of FIG. 4.

In any event, the travel route data structures provide a sequence of latitude and longitude values with end points in the sequence being representative of either a destination or origin depending on the direction of travel for vehicle 10.

Once a collection of travel routes have been stored in device 30, the operator of vehicle 10 selects a travel route by invoking the travel mode of device 30. While in travel mode, device 30 compares incoming traffic event information with the remaining portion of the travel route, and if relevant to the remaining portion of the travel route, displays such traffic event information for the driver of vehicle 10 on display 34.

Figure 5:
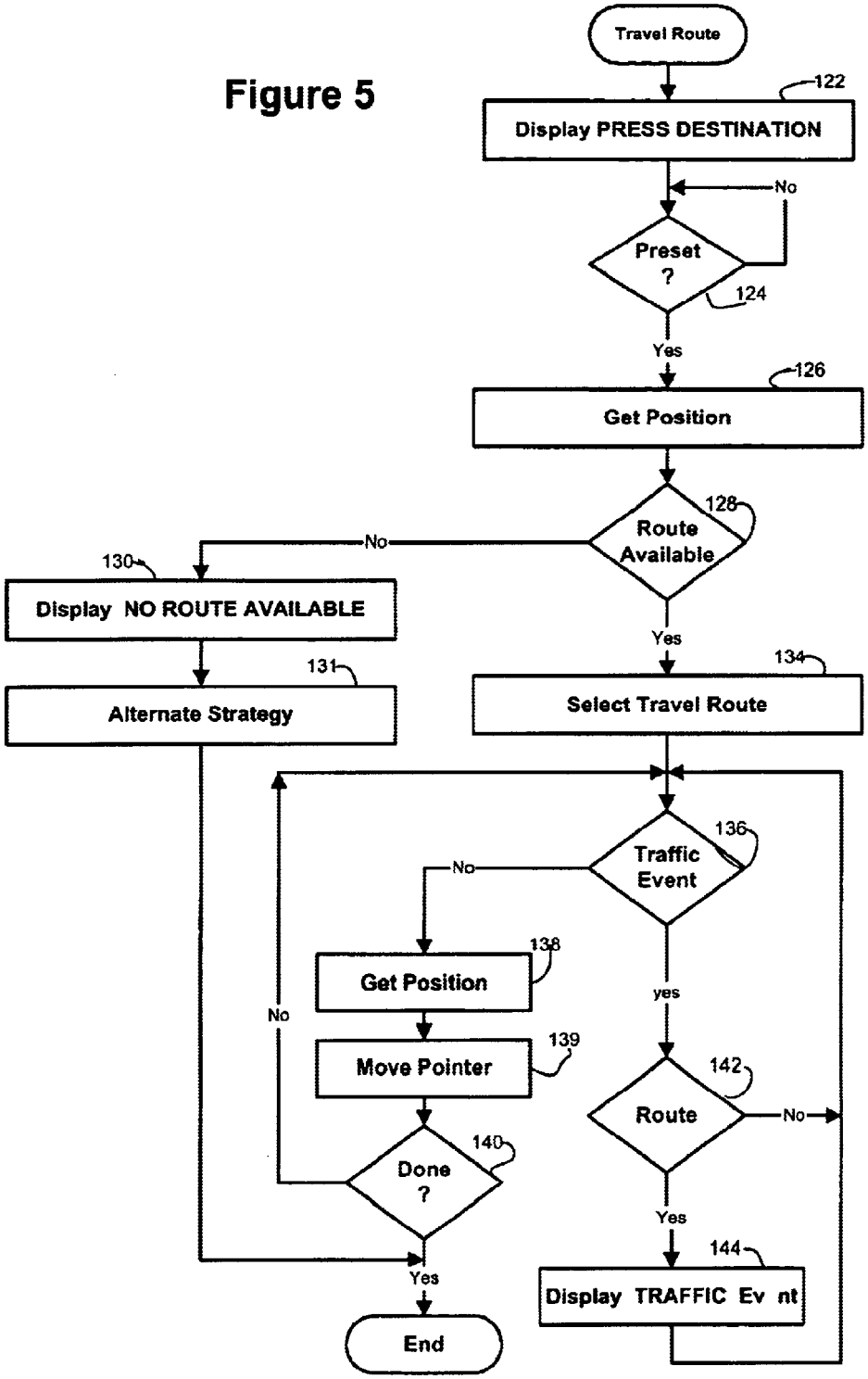
FIG. 5 is a flow chart illustrating operation of the device of FIG. 2 while travelling along a given travel route as represented by a data structure of FIG. 4.

FIG. 5 illustrates operation of device 30 while in a travel route mode 120 as invoked by operation of travel route button 121. In FIG. 5, travel route mode 120 begins in block 122 where device 30 displays the message PRESS DESTINATION and loops at decision block 124 until the operator has depressed one of preset buttons 50. After the user has depressed one of preset buttons 50, device 30 collects the current vehicle position in block 126. Continuing to decision block 128, device 30 compares the indicated current vehicle position with the stored travel routes to determine whether a travel route is available based on the current vehicle position and the indicated destination. More particularly, an appropriate travel route should indicate a location associated with the preset button 50 detected as activated in decision block 124 and with the current vehicle position as detected in block 126. Preferably, the location associated with the preset button 50 indicated in block 124 should correspond to an end point of one of the stored travel routes and the current vehicle position should correspond to the other end point of that stored travel route. As may be appreciated, however, variation and flexibility in the test provided by decision block 128 may be provided whereby device 30 does not require absolutely that the locations indicated in blocks 124 and 126 correspond to end points of the travel routes, e.g., the position indicated in block 126 could be a location along one of the travel routes whereby the driver of vehicle 10 could invoke travel route mode 120 while traveling to a given destination. Furthermore, the distance from a detected travel route at the time of entering travel mode 120 could establish a range of proximity required to designate a given traffic event as being geographically relevant to the selected travel route.

If no available travel route is indicated by decision block 128, then processing would branch to block 130 where device 30 would display the message NO TRAVEL ROUTE AVAILABLE. Continuing from block 130, an alternate strategy, as represented by block 131, may be adopted when lacking a stored travel route. For example, device 30 could, given the destination position and current vehicle position, assume a straight line travel route and consider relevant those traffic events lying along such straight line or, for example, within a given distance of such straight line. Such processing would generally be as described hereafter with respect to a selected travel route, but adapted where necessary to reflect an assumed travel route corresponding to a straight line, and an adjacent area of given proximity, connecting the point of origin and point of destination.

A second alternate strategy represented by block 130 places device 30 into a position scanning mode in an attempt to identify a current vehicle position corresponding in location to one of the stored travel routes. Once a correspondence is detected, i.e., between current vehicle position and a stored travel route, device 30 continues to scan vehicle position to determine whether the driver has begun following the corresponding travel route. If the vehicle begins moving along that route, then the route is automatically selected and processing continues as described herein with respect to a selected travel route. This feature is useful when, for example, the vehicle is in a location not associated with a stored travel route, e.g., at the beech, and the driver wishes to travel to a location associated with a stored travel route, e.g., wishes go home from the beech. Once the driver gets onto a familiar route, the route is selected and traffic event information reported against that selected route.

Assuming device 30 identifies an appropriate travel route in decision block 128, processing advances to block 134 where the stored travel route data structure is selected for use. Such selection process would include a selected ordering of the sequence of latitude and longitude information stored therein, and possibly an identification of the vehicle as being along or near one of the stored travel routes such as when the operator of vehicle 10 invokes travel route mode 120 when not at an end point of a stored travel route.

Continuing to decision block 136, device 30 interrogates a queue of pending traffic events as received by way of radio receiver 40. As may be appreciated, device 30 can collect traffic events in a queue whereby upon entry of travel route mode 120 recent traffic event information would be available for processing. If no traffic event is presently pending processing, device 30 advances to block 138 where it collects the current vehicle position.

Continuing to block 139, device 30 updates a pointer into the selected travel route indicating a position along the selected travel route. As may be appreciated, such a pointer indicating position along the travel route specifies the remaining portion of the travel route and thereby provides a basis for also filtering traffic events relevant only to already traversed portions of the travel route.

Continuing to block 140, device 30 tests whether vehicle 10 has arrived at the indicated destination. If vehicle has arrived at the indicated destination, then processing exits travel route mode 120. Furthermore, decision block 140 may also test for significant deviation in current vehicle position relative to the selected travel route as a further basis for exiting travel route mode 120. Assuming the vehicle 10 has not yet reached its destination or deviated significantly from the selected travel route, processing returns to decision block 136 where pending traffic events are processed.

When traffic events are pending processing in device 30, processing advances to decision block 142 where device 30 determines whether an indicated traffic event is relevant to the currently selected travel route, i.e., test whether the traffic event is on or sufficiently near the selected travel route. If the traffic event is not on or near the selected travel route, then processing simply returns to decision block 136 for further processing of pending traffic events. If, however, the pending traffic event is relevant to the selected travel route, then processing advances to block 144 where device 30 displays the traffic event on display 34 and then returns to decision block 136. As may be appreciated, processing of more than one pending traffic event may be conducted in response to decision block 136. Because device 30 is capable of processing a number of traffic events for a very short travel distance of vehicle 10, it is not necessary to branch through the blocks 138, 139, and 140 for each of the numerous travel events collected by device 30.

Thus, the travel route mode 120 of device 30 filters from among a massive volume of traffic event information provided by radio broadcast system 20 and provides for display to the driver of vehicle 10 only those traffic events relevant to a selected travel route. Because the operator of vehicle 10 makes most use of vehicle 10 along a limited number of travel routes, especially with respect to every day commuting activity, information device 30 provides a valuable navigational aid responding automatically to ongoing and relevant travel events within road network 12.

As may be appreciated, the comparison of latitude and longitude values as discussed herein should allow flexibility by testing against a range of values. Also, a range of values may be indicated in traffic event information, i.e., latitude and longitude ranges indicating a section of a roadway and the need for range testing rather than one-to-one position testing. In any event, comparison of longitude and latitude data relative to specific locations 14 or portions of road network 12 must take into account the resolution of such positioning information as available from the global positioning system and a sufficient margin of error to provide in the display 34 information not only relevant to the direct route of travel but also traffic event information near the selected travel route.

Thus, an improved information device has been shown and described wherein a vehicle travelling within a road network need not include a massive digital map database representing the road network as a mechanism for filtering among a large volume of incoming traffic event information. Under the present invention, the information device constructs travel routes in accordance with user definition and references such travel routes when filtering traffic event information. In this manner, the device of the present invention may be configured at the time of manufacture for operation in any location throughout the world, and need not be specially modified or updated relative to changes in road networks. In other words, the device of the present invention is adaptive to current use of a given vehicle by allowing the user to simply redefine any selected travel routes commonly used.

It will be appreciated, that the present invention is not restricted to the particular embodiment or embodiments that have been described and illustrated herein, and that variations may be made therein without departing from the scope of the invention as found in the appended claims and equivalents thereof.

What is claimed is:

1. A method of presenting traffic event information at a vehicle, the method comprising the steps:

transmitting a stream of traffic event information, said traffic event information including a descriptive portion and a location portion;

monitoring said stream of traffic event information at said vehicle;

comparing at said vehicle said location portion of said traffic event information relative to a previously stored travel route model specifying a corresponding travel route of said vehicle, said travel route model being defined at said vehicle while said vehicle was previously traversing said travel route; and displaying for presentation at said vehicle a subset of monitored traffic events, said subset including only events which coincide geographically with said travel route.

2. A method according to claim 1 wherein said travel route model comprises a sequence of location data collected and stored by said vehicle while said vehicle is traversing said travel route.

3. A method according to claim 1 wherein said method further comprises the steps:

maintaining a collection of stored travel route models at said vehicle, each travel route model specifying a corresponding travel route, each travel route model being defined at said vehicle while traversing the corresponding travel route; and selecting one of said stored travel route models to dictate said subset of traffic events displayed.

4. A method according to claim 1 wherein each travel route model is defined by collecting vehicle position data while said vehicle is traversing the corresponding travel route.

5. A method according to claim 1 wherein said method further comprises the step of providing at said vehicle a vehicle position detecting device and each travel route model is defined by collecting and storing a sequence of vehicle position information taken from said vehicle detecting device while traversing the corresponding travel route.

6. A method of filtering for display traffic event information at a vehicle, said traffic event information being broadcast by radio signal and providing information relative to a given road network, the method comprising the steps:

defining a travel route model by traversing with said vehicle a corresponding travel route within said road network while collecting and storing a sequence of current vehicle position data;

monitoring said broadcast of said traffic event information; and displaying a subset of said traffic event information, said subset being events which coincide with said travel route model.

7. A method according to claim 6 wherein traffic event information includes a geographic location portion, and wherein said subset of said traffic event information is coincides with locations on said travel route model when a geographic correspondence exists between the geographic location portion of a given traffic event and vehicle position data and points therebetween of said travel route model.

8. A method according to claim 7 wherein said geographic correspondence comprises said location portion indicating a given range of proximity relative to a portion of said travel route model.

9. A method according to claim 6 wherein said method further comprises the steps:

maintaining a collection of stored travel route models at said vehicle, each travel route model specifying a corresponding travel route, each travel route model being defined at said vehicle while traversing the corresponding travel route; and selecting one of said stored travel route models to dictate said subset of traffic events displayed.

10. An information receiving and displaying device for a vehicle, said device comprising:

a vehicle position sensing device;

a data receiving device responsive to transmitted event information, each item of event information including a descriptive portion and a location portion;

a display for presenting items of event information to a vehicle driver;

a processing and data storage element coupled to said vehicle position sensing device, said data receiving device, and to said display whereby said processing element collects transmitted event information and displays a selected subset of said event information on said display, said processing element including a learn mode defining a travel route model by collecting and storing vehicle position information while said vehicle traverses a corresponding travel route, said travel route model being referenced in selecting said subset of event information for display.

11. A device according to claim 10 wherein said processing element references said travel model to identify event information which geographically coincide with said travel route model.

12. A device according to claim 11 wherein said processing element takes as relevant that event information including a location portion within a given geographic proximity relative to said vehicle position information and points therebetween indicated in said travel route model.

13. A device according to claim 10 wherein the learn mode of said device may be activated multiple times to establish multiple travel route models, and said device further includes a travel mode including selection of a stored travel route with reference to said selected travel route model in selecting said subset of event information for display.

* * * * *